US005252150A

United States Patent [19]

Yuki et al.

[11] Patent Number: 5,252,150

[45] Date of Patent: Oct. 12, 1993

[54] PROCESS FOR PRODUCING NITROGEN CONTAINING TI-AL ALLOY

[75] Inventors: Isamu Yuki, Toyota; Minoru Uozumi, Aichi; Ryoji Nakamura, Toyota, all of Japan

[73] Assignee: Toyota Jidosha Kabushiki Kaishi, Japan

[21] Appl. No.: 907,618

[22] Filed: Jul. 2, 1992

Related U.S. Application Data

[62] Division of Ser. No. 698,096, May 10, 1991, Pat. No. 5,152,960.

[30] Foreign Application Priority Data

May 18, 1990 [JP] Japan ..... 2-130093
Mar. 12, 1991 [JP] Japan ..... 3-73990

[51] Int. Cl.[5] ..... C22C 14/00

[52] U.S. Cl. ..... 148/421; 148/206; 148/236; 148/669; 420/417; 420/418

[58] Field of Search ..... 148/421, 669, 206, 236; 420/417, 418

[56] References Cited

U.S. PATENT DOCUMENTS

| | | | |
|---|---|---|---|
| 3,008,823 | 11/1961 | McAndrew | 75/175.5 |
| 3,203,794 | 8/1965 | Jaffee et al. | 420/417 |
| 3,625,679 | 12/1971 | Bomberger, Jr. | 75/175.5 |
| 3,642,546 | 2/1972 | Van Thyne et al. | 148/206 |
| 4,279,650 | 7/1981 | Jackman et al. | 420/418 |
| 4,420,460 | 12/1983 | Crossley | 420/418 |
| 4,639,281 | 1/1987 | Sastry et al. | 420/418 |
| 4,849,168 | 7/1989 | Nishiyama et al. | 420/418 |
| 5,141,574 | 8/1992 | Takahashi et al. | 148/206 |

FOREIGN PATENT DOCUMENTS

| | | |
|---|---|---|
| 0275391 | 7/1988 | European Pat. Off. . |
| 63-125634 | 5/1988 | Japan . |
| 64-79335 | 3/1989 | Japan . |
| 2-258939 | 10/1990 | Japan . |

OTHER PUBLICATIONS

Badini et al. Jour. Less-Common-Metals 143 (1988) 129.

Bars et al. Jour. Less-Common Metals 52 (1977) 51.

*Primary Examiner*—Upendra Roy
*Attorney, Agent, or Firm*—Finnegan, Henderson, Farabow, Garrett & Dunner

[57] ABSTRACT

Disclosed are a Ti—Al alloy including aluminum (Al) in an amount of 30 to 38% by weight, nitrogen (N) in an amount of 0.2 to 1.0% by weight, and titanium (Ti), substantially the balance, and a process for producing the same. Since the Ti—Al alloy includes the nitrogen in the predetermined amount, the microstructure of the Ti—Al ally can be micro-fined and made into a uniform one, and accordingly the shrinkage cavities can be reduced remarkably. Therefore, the strength, the ductility or the like of the Ti—Al alloy can be improved remarkably. With the production process, it is possible to produce the Ti—Al alloy including the nitrogen in the predetermined range.

8 Claims, 2 Drawing Sheets

PROCESS FOR PRODUCING NITROGEN CONTAINING TI-AL ALLOY

This is a division of application Ser. No. 07/698,096, filed may 10, 1991 now U.S. Pat. No. 5,152,960.

BACKGROUND OF THE INVENTION

1. Field of the Invention

The present invention relates to a Ti—Al alloy, having a light weight and a heat resistance property and being applicable to a rotary member such as a turbine wheel, a valve system member such as an engine valve or the like, and a process for producing the same.

2. Description of the Related Art

It has been known that 3 intermetallic compounds are present in a Ti—Al binary system alloy including titanium and aluminum, i.e., $Ti_3Al$, TiAl and $TiAl_3$. Since the TiAl has a specific gravity of 3.8 and accordingly it is light, and since it has a high strength at an elevated temperature, it has been regarded as a promising one for a light-weighted and heat resistant material. However, since the TiAl lacks a ductility at room temperature, it is hard to process it plastically. In addition, when castings are formed with the Ti—Al binary system alloy by casting, shrinkage cavities are likely to occur in the castings. Accordingly, no favorable castings can be obtained.

Developments have been carried out so far in order to improve the properties of the Ti—Al binary system alloy. For instance, Japanese Unexamined Patent Publication No. 125634/1988 discloses a Ti—Al alloy comprising aluminum, boron and titanium, substantially the balance. Further, Japanese Unexamined Patent Publication No. 79335/1989 discloses a Ti—Al alloy comprising aluminum, at least one of nickel and silicon and titanium, substantially the balance. However, the Ti—Al alloys do not improve the properties of the alloy satisfactorily. Although the room temperature ductility is improved slightly when boron is added to Ti—Al alloy and the contents of carbon, oxygen and nitrogen are controlled, the castability of the Ti—Al alloy deteriorates. Thus, the addition of boron to Ti—Al alloy does not improve the castability satisfactorily.

SUMMARY OF THE INVENTION

It is therefore an object of the present invention to improve a strength and a ductility of a Ti—Al alloy. The above and other objects of the present invention can be achieved by an Ti—Al alloy and a process for producing the same according to the present invention.

A Ti—Al alloy according to the present invention comprises:

aluminum (Al) in an amount of 30 to 38% by weight;
nitrogen (N) in an amount of 0.2 to 1.0% by weight; and
titanium (Ti), substantially the balance.

The Ti—Al alloy contains aluminum in the amount of 30 to 38% by weight. When the Ti—Al alloy contains aluminum in an amount of more than 38% by weight, the ductility of the Ti—Al alloy decreases, thereby deteriorating the processability. When the Ti—Al alloy contains aluminum in an amount of less than 30% by weight, $Ti_3Al$ generates in a large amount, $Ti_3Al$ makes the Ti—Al alloy brittle, and accordingly the aluminum content is unfavorable. It is further preferred that the Ti—Al alloy contains aluminum in an amount of 32 to 36% by weight.

The Ti—Al alloy contains nitrogen, entered into the solid solution thereof, in the amount of 0.2 to 1.0% by weight. When the Ti—Al alloy contains nitrogen in an amount of less than 0.2% by weight, no nitrogen addition effect (i.e., the strength and ductility improvement effect) is appreciated. Therefore, such a nitrogen content is unfavorable. When the Ti—Al alloy contains nitrogen in an amount more than 1.0% by weight, inclusions generate increasingly, thereby deteriorating the strength and the ductility of the Ti—Al alloy. As a result, pressure leakages occur at the boundaries between the inclusions and the normal alloy structures when the Ti—Al alloy having the nitrogen content is cast into castings. Therefore, such a nitrogen content is unfavorable. The inventors assume that the inclusions are presumably nitride resulting from the reaction of titanium with nitrogen. Thus, when nitrogen is entered into the solid solution of the Ti—Al alloy in the amount of 0. 2 to 1.0% by weight according to the present invention, the structure of the Ti—Al alloy is micro-fined and made into a uniform one. As a result, the mechanical properties of the Ti—Al alloy can be improved. In addition, it is further preferred that the Ti—Al alloy contains nitrogen in an amount of 0.3 to 0.8% by weight.

On the other hand, in the conventional Ti—Al alloys, it has been said that the upper limit of the nitrogen content must be less than 0.2% by weight. Since the ductility or the like of Ti—Al alloy deteriorates, it has been also said that it is unfavorable that Ti—Al alloy contains nitrogen in an amount of more than the upper limit. However, according to the research and development carried out by the inventors of the present invention, it has been found that the microstructure of Ti—Al alloy can be micro-fined and made into a uniform one even when Ti—Al alloy contains nitrogen in an amount of more than the conventional nitrogen content. Thus, the inventors have completed the present invention.

A process for producing a Ti—Al alloy according to the present invention comprises the steps of:

(1) a solution heat treatment step of holding metallic titanium heated to from 800° C. or more to a melting point thereof or less in a nitrogen gas atmosphere, thereby entering nitrogen into solid solution of the metallic titanium; and (2) an alloying step of adding to and dissolving aluminum in the metallic titanium whose solid solution includes nitrogen entered thereinto in a vacuum or an inert gas atmosphere, thereby producing a Ti—Al alloy.

As set forth above, the process for producing a Ti—Al alloy according to the present invention comprises the solution heat treatment step in which nitrogen is entered into the solid solution of the metallic titanium, and the alloying step in which aluminum is added to and dissolved in the metallic titanium whose solid solution includes the nitrogen entered thereinto.

In the solution heat treatment step, the metallic titanium is heated in a temperature range of from 800° C. or more to the melting point thereof or less and brought into contact with a nitrogen gas, thereby controlling an amount of the nitrogen entering into the solid solution of the metallic titanium. It is preferred to carry out this step in a vacuum in order to inhibit the metallic titanium from reacting with another gas, such as oxygen or the like, and in order to make a nitrogen gas pressure control easier.

When the temperature of the metallic titanium is less than 800° C., the nitrogen hardly eliters into the solid solution of the metallic titanium. Accordingly, it is not preferable to carry out the solution heat treatment step at a temperature less than 800° C. When the temperature of the metallic titanium is more than the melting point of the metallic titanium, the metallic titanium reacts with the nitrogen explosively and the reaction is hardly controlled. Accordingly, it is not preferable to carry out the solution heat treatment step at a temperature more than than the melting point. Hence, the temperature of the metallic titanium is controlled in a range of from 800° C. or more to the melting point thereof or less. It is further preferred to carry out the solution heat treatment in a temperature range of from 800° to 1650° C. An amount of the nitrogen entering into the solid solution of the metallic titanium can be controlled by adjusting the nitrogen gas pressure and a time for contacting the nitrogen gas with the metallic titanium.

Further, since the nitrogen is entered into the solid solution of the metallic titanium, it is preferable to give the metallic titanium a large surface area in advance. For instance, the metallic titanium may be employed in a form of a fine powder, a sponge or the like. Furthermore, after entering the nitrogen into the solid solution of the metallic titanium, the metallic titanium may be placed in an inert gas atmosphere, such as a helium, neon, argon, krypton or xenon gas atmosphere, in order to control the progress of the reaction.

In the alloying step, the aluminum is added to and dissolved in the solid solution of the metallic titanium whose solid solution includes the nitrogen entered thereinto in an inert gas atmosphere, such as a helium, neon, argon, krypton or xenon gas atmosphere, in order to produce a Ti—Al alloy. During this step, the amount of the nitrogen entered into the solid solution of the metallic titanium does not fluctuate. Hence, it is possible to produce a Ti—Al alloy having the predetermined nitrogen content with ease.

Since the microstructure of the Ti—Al alloy according to the present invention is micro-fined by including the nitrogen in the predetermined amount, the Ti—Al alloy becomes a favorable one. Accordingly, the physical properties of the Ti—Al alloy, such as the strength, the ductility or the like, have been improved. In the case that the Ti—Al alloy is made into a castings, since the microstructure of the Ti—Al alloy contains less inclusions and is uniform, it is possible to cast a product free from shrinkage cavities and pressure leakages.

Since the nitrogen is not directly entered into the solid solution of the Ti—Al alloy but the metallic titanium is treated with the nitrogen in the predetermined temperature range in the process for producing the Ti—Al alloy according to the present invention, it is possible to enter the nitrogen into the solid solution of the metallic titanium in the predetermined amount. After the treatment, the aluminum is added to and dissolved in the metallic titanium whose solid solution includes the nitrogen entered thereinto. Accordingly, it is possible to produce the Ti—Al alloy having the predetermined nitrogen content with ease.

As described above, the Ti—Al alloy of the present invention can be formed to contain the nitrogen in the predetermined amount, i.e. , in the controlled range of 0.2 to 1.0% by weight, by the process for producing the Ti—Al Alloy according to the present invention. Since the Ti—Al alloy of the present invention contains nitrogen in the amount more than the conventional Ti—Al alloys do, the microstructure of the Ti—Al ally is micro-fined and the shrinkage cavities are reduced remarkably. Thus, it is possible to form an intermetallic compound having excellent physical properties. As a result, it is possible to improve the strength, the ductility or the like of the Ti—Al alloy remarkably. Therefore, the Ti—Al alloy of the present invention can be employed as a light-weighted and heat-resistant material for casting a rotary member or the like in an actual application.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
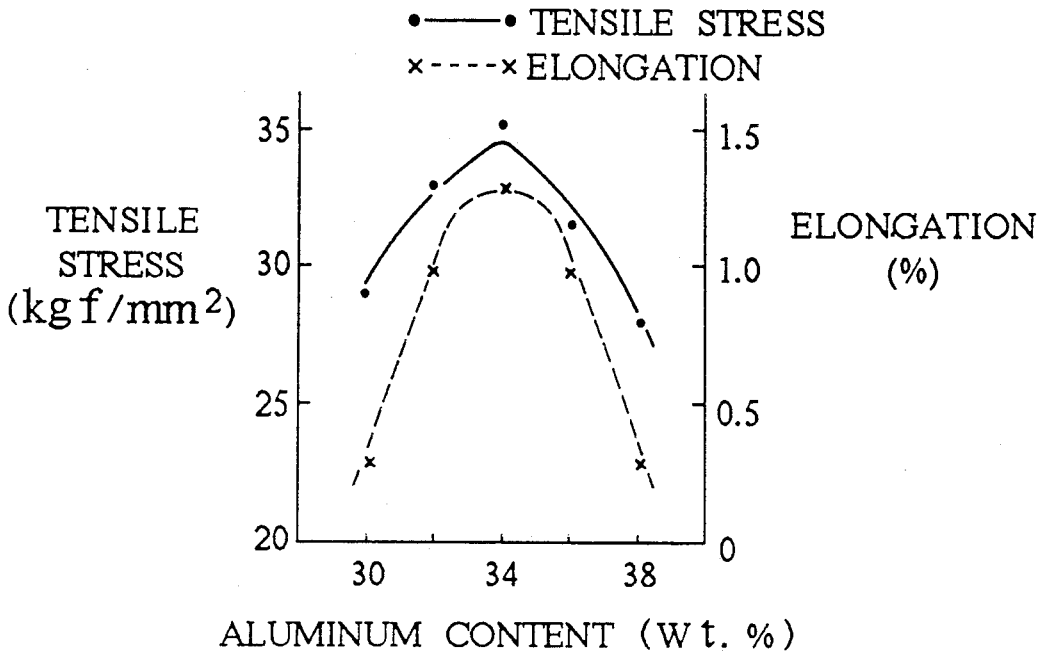
FIG. 1 is a graph illustrating relationships between aluminum contents and tensile stresses as well as elongations in Ti—Al alloys having a nitrogen content fixed at around 0.4% by weight.

Having generally described the present invention, a further understanding can be obtained by reference to the specific preferred embodiments which are provided herein for purposes of illustration only and are not intended to limit the scope of the appended claims.

EXAMPLES 1 THROUGH 12 AND EXAMPLES 20 THROUGH 23

Examples 1 through 12 as well as Examples 20 through 23 of a Ti—Al alloy of the present invention containing nitrogen in an amount ranging from 0.2 to 1.0% by weight were produced by varying the pressure of a nitrogen gas as set forth in Tables 1 and 2.

Here, in Examples 1 through 4, the amount of aluminum to be added to and dissolved in metallic titanium was set at 30% by weight. In Example 20, the amount of the aluminum was set at 32% by weight. In Examples 5 through 8 as well as Examples 22 and 23, the amount of the aluminum was set at 34% by weight. In Example 21, the amount of the aluminum was set at 36% by weight. In Examples 9 through 12, the amount of the aluminum was set at 38% by weight.

The designed aluminum addition amounts of the produced Ti—Al alloys, the nitrogen gas pressures employed in the following solution heat treatment step and so on are summarized in Tables 1 and 2.

Solution Heat Treatment Step

A high frequency vacuum melting furnace was employed, and a raw material (i.e., metallic titanium in a form of sponge) was supplied into the melting. furnace. The metallic titanium was heated in an atmosphere in a vacuum degree of $5\times10^{-4}$ Torr. When the temperature of the metallic titanium was raised to 1300° C., nitrogen gases having the predetermined pressures as set forth in Tables 1 and 2 were introduced into the melting furnace. After holding the melting furnace in the atmospheres for 1 minute, the nitrogen gases were evacuated from the melting furnace, and then an argon gas was introduced into the melting furnace in order to raise a pressure therein to 760 Torr (i.e., I atm) and stop the nitrogen from entering into the solid solution of the metallic titanium.

Alloying Step

Then, aluminum was added to and dissolved in the solid solutions of the metallic titanium so as to form Examples 1 through 4 of the Ti—Al alloy of the present invention having the aluminum content of 30% by weight, Example 20 of the Ti—Al alloy having the aluminum content of 32% by weight, Examples 5 through 8 as well as Examples 22 and 23 of the Ti—Al alloy having the aluminum content of 34% by weight, Example 21 of the Ti—Al alloy having the aluminum content of 36% by weight, and Examples 9 through 12 of the Ti—Al alloy having the aluminum content of 38% by weight.

The molten metals of Examples 1 through 12 as well as Examples 20 through 23 of the Ti—Al alloy thus obtained were cast into test specimens having a dumbbell shape with a ceramic shell mold in an argon gas atmosphere of 760 Torr (i.e. , 1 atm).

COMPARATIVE EXAMPLES 14 THROUGH 19 AND COMPAATIVE EXAMPLES 24 THROUGH 27

After heating the sponge-shaped metallic titanium similarly with the high frequency vacuum melting furnace identical with the one employed to form Examples 1 through 12 as well as Examples 20 through 23 of the Ti—Al alloy in a vacuum, an argon gas was introduced into the melting furnace, and then predetermined amounts of aluminum were added to and dissolved in the solid solutions of the metallic titanium so as to form Comparative Examples 17 through 19 and Comparative Examples 24 through 27 of the Ti—Al alloy.

In particular, Comparative Examples 14 through 16 of the Ti—Al alloys having nitrogen amounts greater than those of Examples 1 through 12 and Examples 20 through 23 were formed by increasing the pressure of the nitrogen gas to 100 Torr.

Further, Comparative Examples 24 and 25 of the Ti—Al alloy were produced by setting the aluminum addition amount at 32 and 36% by weight respectively, but they did not undergo the solution heat treatment step. Furthermore, Comparative Example 26 of the Ti—Al alloy was produced by setting the aluminum addition amount at 34% by weight, and nitrogen was introduced into the melting furnace at 3 Torr. Namely, Comparative Example 26 of the Ti—Al alloy contains an insufficient amount of nitrogen. Moreover, Comparative Example 27 of the Ti—Al alloy was produced in accordance with Japanese Unexamined Patent Publication No. 125634/1988. Namely, Comparative Example 27 of the Ti—Al alloy was produced by adding boron (B) as the third constituent in an amount of 0. 05% by weight to Comparative Example 18.

Likewise, the molten metals of Comparative Examples 14 through 19 and Comparative Examples 24 through 27 thus obtained were cast into the above-described test specimens having the dumbbell shape with the ceramic shell mold in the argon gas atmosphere.

EVALUATION

The prepared test specimens were evaluated as follows. The results of the evaluation test are also summarized in Tables 1 and 2.

The test specimens were subjected to the following evaluation tests:

A chemical component analysis in which the aluminum, nitrogen contents and so on in the Ti—Al alloys were analyzed;

An ordinary temperature tensile strength test in which a strain rate of $10^{-3}$ $sec^{-1}$ was applied to the test specimens;

A pressure leakage test in which an air pressure of 2280 Torr (i.e., 3 atm) was applied to an automobile casing cast from Examples and Comparative Examples of the Ti—Al alloy in order to evaluate presence of the shrinkage cavities;

A microstructure observation in which grain sizes of the Examples and Comparative Examples of the Ti—Al alloy and presence of the inclusions therein were observed with an optical microscope; and Presence of the shrinkage cavities were observed.

As set forth in Tables 1 and 2, the analyzed aluminum contents fell in a permissible error range with respect to the intended aluminum addition amounts. Hence, it is possible to control the amount of aluminum added to and dissolved in the Ti—Al alloy by the process according to the present invention.

TABLE 1

| | Designed Al Amount (wt. %) | $N_2$ Gass Pressure (Torr) | Analyzed Contents (wt. %) Al | N | Tensile Test Stress ($kgf/mm^2$) | Elongation (%) | Pressure Leakage (c.c./min.) | Microstructure Grain Size (mm) | Inclusion | Shrinkage Cavities in Castings |
|---|---|---|---|---|---|---|---|---|---|---|
| Ex. | | | | | | | | | | |
| 1 | 30 | 5 | 30.2 | 0.20 | 27.8 | 0.3 | 0 | 0.1 or less | none | none |
| 2 | 30 | 10 | 30.0 | 0.39 | 29.1 | 0.3 | 0 | 0.1 or less | none | none |
| 3 | 30 | 20 | 29.9 | 0.51 | 30.0 | 0.3 | 0 | 0.1 or less | none | none |
| 4 | 30 | 50 | 30.2 | 0.79 | 28.4 | 0.3 | 0 | 0.1 or less | none | none |
| 5 | 34 | 5 | 33.8 | 0.21 | 33.2 | 1.0 | 0 | 0.1 or less | none | none |
| 6 | 34 | 10 | 34.1 | 0.37 | 35.1 | 1.3 | 0 | 0.1 or less | none | none |
| 7 | 34 | 20 | 33.9 | 0.52 | 35.6 | 1.3 | 0 | 0.1 or less | none | none |
| 8 | 34 | 50 | 33.9 | 0.84 | 34.9 | 1.0 | 0 | 0.1 or less | none | none |
| 9 | 38 | 5 | 38.0 | 0.25 | 25.4 | 0.3 | 0 | 0.1 or less | none | none |
| 10 | 38 | 10 | 37.7 | 0.41 | 27.8 | 0.3 | 0 | 0.1 or less | none | none |
| 11 | 38 | 20 | 37.8 | 0.49 | 27.4 | 0.3 | 0 | 0.1 or less | none | none |
| 12 | 38 | 50 | 37.9 | 0.95 | 26.1 | 0.3 | 0 | 0.1 or less | none | none |

TABLE 1-continued

| | Designed Al Amount (wt. %) | $N_2$ Gass Pressure (Torr) | Analyzed Contents (wt. %) Al | N | Tensile Test Stress (kgf/mm$^2$) | Elongation (%) | Pressure Leakage (c.c./min.) | Microstructure Grain Size (mm) | Inclusion | Shrinkage Cavities in Castings |
|---|---|---|---|---|---|---|---|---|---|---|
| Comp. Ex. | | | | | | | | | | |
| 14 | 30 | 100 | 30.0 | 1.67 | 21.5 | 0 | 30 | 0.1 or less | present | none |
| 15 | 34 | 100 | 34.2 | 1.41 | 22.5 | 0.3 | 25 | 0.1 or less | present | none |
| 16 | 38 | 100 | 37.7 | 1.36 | 18.9 | 0 | 45 | 0.1 or less | present | none |
| 17 | 30 | — | 30.1 | 0.01 | 22.4 | 0 | 70 | 1.0-2.0 | none | present |
| 18 | 34 | — | 33.9 | 0.01 | 23.1 | 0.3 | 65 | 1.0-1.5 | none | present |
| 19 | 38 | — | 37.8 | 0.01 | 19.7 | 0 | 90 | 0.5-1.5 | none | present |

TABLE 2

| | Designed Al Amount (wt. %) | $N_2$ Gass Pressure (Torr) | Analyzed Contents (wt. %) Al | N | B | Tensile Test Stress (kgf/mm$^2$) | Elongation (%) | Pressure Leakage (c.c./min.) | Microstructure Grain Size (mm) | Inclusion | Shrinkage Cavities in Castings |
|---|---|---|---|---|---|---|---|---|---|---|---|
| Ex. | | | | | | | | | | | |
| 20 | 32 | 10 | 32.1 | 0.35 | — | 32.8 | 1.0 | 0 | 0.1 or less | none | none |
| 21 | 36 | 10 | 35.8 | 0.39 | — | 31.6 | 1.0 | 0 | 0.1 or less | none | none |
| 22 | 34 | 15 | 34.0 | 0.27 | — | 34.7 | 1.3 | 0 | 0.1 or less | none | none |
| 23 | 34 | 30 | 34.2 | 0.63 | — | 35.2 | 1.3 | 0 | 0.1 or less | none | none |
| Comp. Ex. | | | | | | | | | | | |
| 24 | 32 | — | 31.9 | 0.01 | — | 22.9 | 0.2 | 70 | 1.0-2.0 | none | present |
| 25 | 36 | — | 36.2 | 0.01 | — | 21.6 | 0.1 | 60 | 0.5-1.5 | none | present |
| 26 | 34 | 3 | 33.8 | 0.14 | — | 28.4 | 0.7 | 20 | 0.2-1.0 | none | present |
| 27 | 34 | — | 33.9 | 0.01 | 0.05 | — | 0.7 | — | 1.0-1.5 | none | present |

As can be seen from Tables 1 and 2, the nitrogen content increased in accordance with the pressure increment in the nitrogen gas pressure range of 5 to 50 Torr. However, in Comparative Examples 14 through 16, the nitrogen content exceeded 1.0% by weight when the nitrogen gas pressure was increased to and introduced at 100 Torr. Further, in Comparative Example 26, the nitrogen content was less than 0.2% by weight when the nitrogen gas was supplied at the pressure of 3 Torr. Accordingly, it is necessary to supply the nitrogen gas at a pressure of 5 Torr or more in order to achieve the predetermined nitrogen content. Hence, it is possible to hold the amount of nitrogen entering into the solid solution of the metallic titanium in the range of 0.2 to 1.0% by weight by controlling the nitrogen gas pressure in the solution heat treatment step. Here, the above-described nitrogen gas pressure is for the case in which the metallic titanium is heated to 1300° C., and the nitrogen gas pressure value depends on the heating temperature of the metallic titanium.

On the other hand, in Comparative Examples 17 through 19, the nitrogen content was 0.01% by weight, and the Ti—Al alloy hardly contained nitrogen when no nitrogen gas was introduced in the heat treatment step. Thus, it is possible to control the nitrogen content in the Ti—Al alloy by the production process according to the present invention.

According to the room temperature tensile test, the test specimens cast from Examples 1 through 12 of the Ti—Al alloy had remarkably improved tensile stresses and elongations. This improvement is obvious when Examples 5 through 8 of the Ti—Al alloy are compared with Comparative Examples 18 having an equivalent aluminum content to those of Examples 5 through 8 but a lesser nitrogen content and Comparative Examples 15 having an equivalent aluminum content to those of Examples 5 through 8 but a greater nitrogen content.

Figure 2:
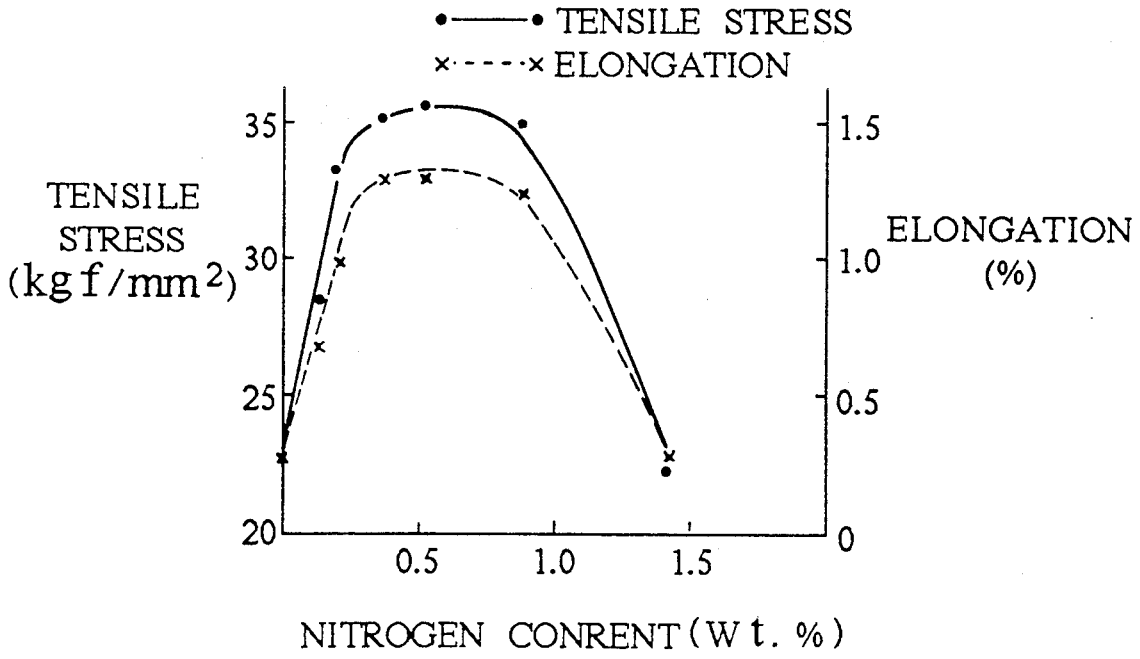
FIG. 2 is a graph illustrating relationships between nitrogen contents and tensile stresses as well as elongations in Ti—Al alloys having an aluminum content fixed at around 34% by weight.

FIG. 1 illustrates relationships between the aluminum contents and the tensile stresses as well as the elongations of the Ti—Al alloys containing nitrogen in an amount of approximately 0.4% by weight (i. e. , Examples 2, 6, 10, 20 and 21). It is apparent from FIG. 1 that there is an optimum aluminum content at around 34% by weight which gives peak values of the tensile stress and the elongation. Further, FIG. 2 illustrates relationships between the nitrogen contents and the tensile stresses as well as the elongations of the Ti—Al alloys containing aluminum in an amount of 34% by weight (i.e., Examples 5, 6, 7, 8, 22 and 23). FIG. 2 tells that the Ti—Al alloy comes to have an excellent tensile stress and elongation when the nitrogen content falls in the predetermined range according to the present invention.

According to the pressure leakage test, the automobile casings cast from Examples 1 through 12 and Examples 20 through 23 of the Ti—Al alloy did not exhibit any pressure leakage. However, the automobile casings cast from Comparative Examples 14 through 19 and Comparative Examples 24 through 26 of the Ti—Al alloy exhibited large pressure leakages. In particular, the automobile casings cast from the Ti—Al alloys containing nitrogen in a lesser amount (i.e., Comparative Examples 17 through 19 and Comparative Examples 24 through 27) exhibited sharply increased pressure leakages (though Comparative Example 27 was not tested). The increasing pressure leakage is believed to result from the grain size which increases when the Ti—Al alloy contains less nitrogen as in Comparative Examples 17 through 19 and Comparative 24 through 27, because they had large grain sizes and many shrinkage cavities occurred during the casting. Further, the automobile casings cast from the Ti—Al alloys containing nitrogen in a greater amount (i.e. , Comparative Example 14 through 16) exhibited large pressure leakages, because they had the inclusions.

As described above, Comparative Example 27 of the Ti—Al alloy was produced in accordance with Japanese Unexamined Patent Publication No. 125634/1988, and boron (B) was added thereto in the amount of 0.05% by weight as set forth in Table 2. The elongation of Comparative Example 27 was 0.7%, and it was better than that of Comparative Example 18 (or the base material thereto) free from the boron or nitrogen addition. However, when the elongation of Comparative Example 27 is compared with those of Examples 5 through 8 and Examples 22 and 23 to which nitrogen is added in accordance with the present invention, it is far inferior to them.

According to the microstructure observation, Examples 1 through 12 and Examples 20 through 23 of the Ti—Al alloy had a grain size as small as 0.1 mm or less. On the other hand, Comparative Examples 17 through 19 of the Ti—Al alloys containing nitrogen in a lesser amount had a larger grain size. Although Comparative Examples 14 through 16 of the Ti—Al alloys containing nitrogen more than 1.0% by weight had a relatively smaller grain size, the inclusions (presumably nitrides) were present in the microstructures of the Ti—Al alloy. Accordingly, it is assumed that pressure leakages occurred because of the pores disposed at the interfaces between the inclusions and the alloy constituents and the shrinkage cavities generating during casting. Especially, in Comparative Examples 17 through 19 and Comparative Examples 24 through 27 to which nitrogen was not added substantially, there occurred the shrinkage cavities. Thus, Comparative Examples 14 through 19 and Comparative Examples 24 through 27 of the Ti—Al alloy do not make favorable castings.

Figure 3:
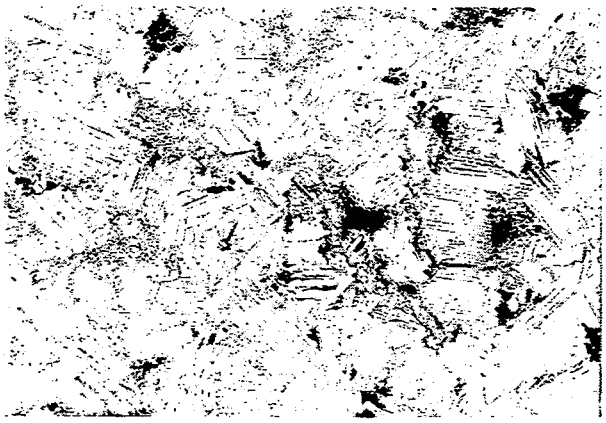
FIG. 3 is a photograph of a microstructure of a casting cast from Example 6 of a Ti—Al alloy according to the present invention.
Figure 4:
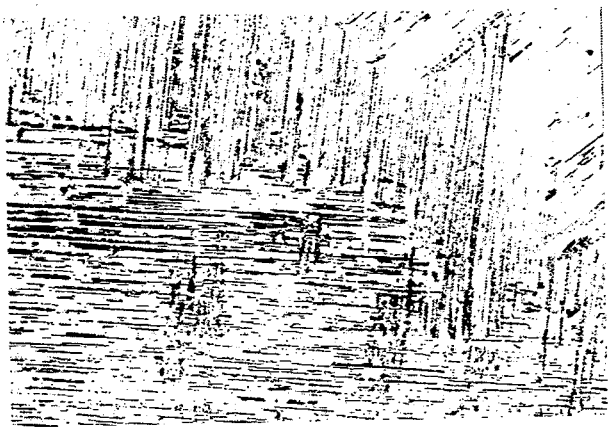
FIG. 4 is a photograph of a microstructure of a casting cast from Comparative Example 18 of a conventional Ti—Al alloy.

In addition, when FIG. 3, a microstructure photograph (magnification × 100) of the Ti—Al alloy comprising aluminum in an amount of 34.1% by weight and nitrogen in an amount of 0.37% by weight (i.e., Example 6), is compared with FIG. 4, a microstructure photograph (magnification × 100) of the Ti—Al alloy comprising aluminum in an amount of 33.9% by weight and nitrogen in an amount of 0.01% by weight (i.e., Comparative Example 18), the following are apparent. In FIG. 3, the microstructure is micro-fined so that the grain size is as small as 0.05 to 0.1 mm in the Ti—Al alloy containing nitrogen. Hence, it is believed that the shrinkage property of the Ti—Al alloy has been improved. On the other hand, in FIG. 4, the microstructure is coarse so that the grain size is as large as 0.5 to 2 mm in the Ti—Al alloy being substantially free from nitrogen. Hence, it is believed that the Ti—Al alloy is likely to generate the shrinkage cavities, and that it suffers from the pressure leakage accordingly.

PRODUCT EVALUATION

The 6 Ti—Al alloys of the present invention having the compositions as set forth in Table 3 were prepared, and made into an engine valve including a head disposed at an end and a stem protruding the head.

TABLE 3

| No. | Al (% by weight) | N (% by weight) |
|---|---|---|
| 1 | 33.8 | 0.31 |
| 2 | 35.9 | 0.21 |
| 3 | 32.2 | 0.42 |
| 4 | 34.3 | 0.37 |
| 5 | 34.1 | 0.23 |
| 6 | 32.0 | 0.85 |

Valves No. 1 and No. 2 were installed on an engine "A" whose specifications are set forth in Table 4. The engine "A" was operated at a speed of 4,300 rpm for 300 hours continuously. Valves No. 3 and No. 4 were installed on an engine "B" whose specifications are set forth in Table 4. The engine "B" was operated at a speed of 6,000 rpm for 200 hours continuously. Further, valves No. 5 and No. 6 were installed on the engine "B." This time, the engine "B" was operated at a speed causing the bouncing phenomenon or more. For instance, the engine "B" was operated at a speed of around 10,000 rpm for a couple of minutes so that the cams could not follow the vertical movements of the valves No. 5 and No. 6. Table 5 summarizes the engine operation conditions and the valve conditions after the tests. Even after the valves No. 1 through 6 had undergone the heavy duty tests, they did not suffer from breakage or the like. Thus, it is apparent that the valves No. 1 through No. 6 made from the Ti—Al alloy of the present invention exhibited durability as high as that of a conventional valve made from steel.

TABLE 4

| Engine | Displacement (liter) | No. of Cylinders | No. of Valves | Max. Speed (rpm) |
|---|---|---|---|---|
| "A" | 2.8 | 4 | 2 | 4,000 |
| "B" | 2.0 | 4 | 4 | 6,800 |

TABLE 5

| No. | Engine | Operation Condition | Breakage or the like |
|---|---|---|---|
| 1 | "A" | 4,300 rpm for 300 Hrs. | None |
| 2 | " | " | None |
| 3 | "B" | 6,000 rpm for 200 Hrs. | None |
| 4 | " | " | None |
| 5 | "B" | At Speed Causing Bouncing or more for a Few Mins. | None |
| 6 | " | At Speed Causing Bouncing or more for a Few Mins. | None |

Having now fully described the present invention, it will be apparent to one of ordinary skill in the art that many changes and modifications can be made thereto without departing from the spirit and scope of the present invention as set forth herein including the appended claims.

What is claimed is:

1. A process for producing a Ti—Al alloy, comprising the steps of:

(1) a solution heat treatment step of holding metallic titanium heated to from 800° C. or more to a melting point thereof or less in a nitrogen gas atmosphere, thereby entering nitrogen into solid solution of said metallic titanium; and (2) an alloying step of adding to and dissolving aluminum in an amount of 30 to 38% by weight in said metallic titanium whose solid solution includes said nitrogen entered thereinto in a vacuum or an inert gas atmosphere, thereby producing a Ti—Al alloy.

2. The process for producing a Ti—Al alloy according to claim 1, wherein said solution heat treatment step is carried out in a vacuum.

3. The process for producing a Ti—Al alloy according to claim 1, wherein said metallic titanium is heated to a temperature falling in a range of 800° to 1650° C. in said solution heat treatment step.

4. The process for producing a Ti—Al alloy according to claim 1, wherein said metallic titanium is in a form of one of a fine powder and a sponge.

5. The process for producing a Ti—Al alloy according to claim 1, wherein said metallic titanium is further placed in an inert gas atmosphere after said solution heat treatment step.

6. The process for producing a Ti—Al alloy according to claim 1, wherein said nitrogen is entered into said solid solution of said metallic titanium in an amount of 0.2 to 1.0% by weight with respect to a Ti—Al alloy produced in said solution heat treatment step.

7. The process for producing a Ti—Al alloy according to claim 6, wherein said aluminum is added to and dissolved in said metallic titanium in an amount of 32 to 36% by weight with respect to a Ti—Al alloy produced in said alloying step.

8. The process for producing a Ti—Al alloy according to claim 6, wherein said nitrogen is entered into said solid solution of said metallic titanium in an amount of 0.3 to 0.8% by weight with respect to a Ti—Al alloy produced in said solution heat treatment step.

* * * * *

UNITED STATES PATENT AND TRADEMARK OFFICE

CERTIFICATE OF CORRECTION

PATENT NO. : 5,252,150

DATED : October 12, 1993

INVENTOR(S) : Isamu YUKI et al.

It is certified that error appears in the above-indentified patent and that said Letters Patent is hereby corrected as shown below:

Claim 7, column 11, line 9, "claim 6" should read --claim 1--.

Signed and Sealed this

Fifth Day of April, 1994

Bruce Lehman

*Attest:*

BRUCE LEHMAN

*Attesting Officer*

*Commissioner of Patents and Trademarks*